US005579789A

United States Patent [19]

Spiegel

[11] Patent Number: 5,579,789

[45] Date of Patent: Dec. 3, 1996

[54] FOOD SOIL HANDLING SYSTEM FOR A DISHWASHER

[75] Inventor: Raymond W. Spiegel, Lincoln Township, Mich.

[73] Assignee: Whirlpool Corporation, Benton Harbor, Mich.

[21] Appl. No.: 368,342

[22] Filed: Jan. 4, 1995

[51] Int. Cl.[6] ..... B08B 13/00

[52] U.S. Cl. ..... 134/104.1; 134/111; 134/176; 134/179; 210/173; 210/396; 210/413; 241/73; 241/84; 241/46.012

[58] Field of Search ..... 134/104.1, 111, 134/115 G, 176, 179; 210/173, 174, 408, 528, 355, 413, 248, 396; 241/73, 84, 203, 89.4, 292.1, 46.012, DIG. 30

[56] References Cited

U.S. PATENT DOCUMENTS

| | | | |
|---|---|---|---|
| 1,148,547 | 8/1915 | Smith | 241/89.4 |
| 1,763,992 | 6/1930 | Smith | 134/111 |
| 1,921,936 | 8/1933 | Mantelet | 241/89.4 |
| 2,540,474 | 2/1951 | Cox | 210/298 |
| 2,612,923 | 10/1952 | Roi | 241/84 |
| 3,275,148 | 9/1966 | Vicino | 210/355 |
| 3,339,851 | 9/1967 | Felton et al. | 241/89.4 |
| 3,468,486 | 9/1969 | Mercer . | |
| 3,491,780 | 1/1970 | Kaldenberg . | |
| 3,496,949 | 2/1970 | Mercer . | |
| 3,677,473 | 7/1972 | Belaieff . | |
| 3,738,596 | 6/1973 | Miles | 241/89.4 |
| 4,038,103 | 7/1977 | Grunewald . | |
| 4,228,962 | 10/1980 | Dingler et al. . | |
| 4,374,134 | 8/1982 | Svehaug | 210/355 X |
| 4,902,412 | 2/1990 | Surbe, III et al. | 210/355 |
| 5,143,306 | 1/1992 | Nilsson . | |
| 5,165,433 | 11/1992 | Meyers . | |

FOREIGN PATENT DOCUMENTS

| | | | |
|---|---|---|---|
| 235989 | 9/1960 | Australia | 210/355 |

*Primary Examiner*—Frankie L. Stinson
*Attorney, Agent, or Firm*—Hill, Steadman & Simpson

[57] ABSTRACT

A food soil handing system for a dishwasher is provided. A main carrier arm has two driver arms rotatably mounted thereon. Each driver arm turns a driver gear engaged with a stationary ring gear. Rotation of the driver arms results in rotation of the main carrier arm, providing significant torque. The main carrier arm is disposed above a drain plate having perforations to drain wash water. A pair of resilient wipers are secured to the main carrier arm to wipe across the plate as the carrier arm rotates. The wipers mash soft food particles through the perforations. Hard items are either swept around or passed over by the wipers for later retrieval.

8 Claims, 2 Drawing Sheets

FOOD SOIL HANDLING SYSTEM FOR A DISHWASHER

BACKGROUND OF THE INVENTION

The present invention generally relates to dishwashers. More specifically, the present invention relates to spray arm arrangements and food soil handling systems for dishwashers.

It is desirable to provide a dishwasher which can effectively wash dishes which are loaded in a wash cavity of the dishwasher, without the dishes having been pre-rinsed to remove food soil. Improvements in dishwashers have led to models which are capable of more adequate removal of heavy food soil. Therefore, dishwasher users have become accustomed to loading dishwashers with dishes which initially have a significant amount of food soil remaining on the dishes, further increasing the demands on dishwasher performance.

During operation of a dishwasher, wash water drains from a basin and is recirculated through a pump. Food particles washed from the dishes are carried by the wash water. A substantial accumulation of such food particles can cause a drain system to clog. Therefore, it is desirable to provide a dishwasher food soil handling system which prevents clogging. In order to prevent such clogging, devices for processing food particles are generally known. For example, U.S. Pat. No. 5,143,306 discloses a dishwasher having rotating knives driven by a motor for scissoring food particles against a grate. Also, U.S. Pat. No. 4,228,962 discloses a dishwasher having a grate which is rotatably driven on a pump shaft against a resilient block.

Hard foreign objects, such as rings, screws, etc., are sometimes accidentally placed inside a dishwasher. These objects can be damaged by a food soil handling device. Likewise, foreign objects or hard food remains such as bones, seeds, etc., can damage a food soil handling device. Therefore, it is desirable to provide a food soil handling system which prevents foreign objects from becoming damaged. Also, it is desirable to provide a food soil handling device which is not itself damaged by loose hard objects present in a dishwasher.

An auxiliary component such as a food soil processing device must be powered. Preferably, such a device is powered by pressure of the wash water exiting a spray arm providing a reaction force which provides the power through a conversion of motion from the rotating spray arm into mechanical motion of the auxiliary device components. Unfortunately, it has been a problem to adequately power auxiliary elements in a dishwasher. More particularly, the torque generated by a traditional spray arm is sometimes insufficient to overcome the frictional resistance of an additional device, or one which provides a significant level of food soil processing.

A traditional dishwasher has a single spray arm rotatably disposed above a bottom wall of the wash cavity. Such a spray arm is caused to rotate by reaction thrust from water exiting through appropriately oriented spray nozzles disposed in the spray arm. A spray arm of this type is incapable of generating adequate torque to power other friction-creating elements. Therefore, it would be desirable to provide a dishwasher spray arm system which provides a substantial amount of torque to power other elements operably connected therewith.

Furthermore, a traditional spray arm has individual nozzles which follow a circular path, the same path being repeated during each revolution. It would be desirable to improve cleaning action by providing a changing spray pattern. Therefore, it would be desirable to provide an improved dishwasher spray arm system which movably directs its nozzles in a changing path.

It is known to provide a dishwasher spray system including multiple rotating spray arms. For example, U.S. Pat. No. 3,667,473 discloses a dishwasher having two small rotating arms mounted on ends of a main carrier arm. Also, U.S. Pat. Nos. 3,496,949 and 3,468,486 disclose dishwashers having one small rotating arm at the end of a main carrier arm. However, in each of these systems, the main arm is freely rotatable and is driven simply by water thrust through nozzles located in the main arm. Therefore, such systems do not create significant torque.

SUMMARY OF THE INVENTION

The present invention provides a dishwasher having a spray arm system which creates a significant amount of torque. The present invention also provides the food soil handling system driven by this torque.

To this end, a dishwasher appliance is provided having a rotatable carrier arm and at least one driver arm. Each driver arm is rotatably mounted to the carrier arm. A ring gear is provided which remains stationary, relative to the dishwasher. Also, a driver gear is associated with each driver arm and is operably connected rotate with the driver arm. Each driver gear is engaged with the stationary ring gear, whereby rotation of each driver arm causes the carrier arm to rotate.

In an embodiment, each driver arm has a plurality of nozzles, the nozzles being directed to provide reaction thrust to the drive arms to provide a rotational motion.

In an embodiment, the dishwasher appliance has two driver arms carried on a single carrier arm. Also, the driver arms and the carrier arm are hollow for delivering a flow of water through each of the arms.

In an embodiment, a dishwasher appliance is provided having a plate positioned above a bottom wall of the wash cavity with a plurality of perforations through the plate for draining wash fluid from the wash cavity. A rotatable carrier arm is disposed above the plate. At least one wiper element is secured to the carrier arm, positioned to resiliently contact against the plate. Each wiper element is operable to force soft materials through the perforations as the carrier arm rotates and drags the wiper over the surface of the plate. Preferably, the wiper elements are sufficiently resilient to pass over hard items too large to fit through the perforations, but which are held stationary on the plate.

It is, therefore, an advantage of the present invention to provide an improved food soil handling system for a dishwasher.

A further advantage of the present invention is to provide a spray arm system for producing substantial torque. Another advantage of the present invention is to provide a spray arm system for washing dishes with a changing spray pattern.

Yet another advantage of the present invention is to provide a food soil handling system resistant to clogging. Moreover, an advantage of the present invention is to provide a food soil handling system that mashes soft food particles.

A still further advantage of the present invention is to provide a food soil handling system which does not damage foreign objects and also which is not itself damaged by hard foreign objects.

Another advantage of the present invention is to provide a food soil handling system that traps had food particles.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
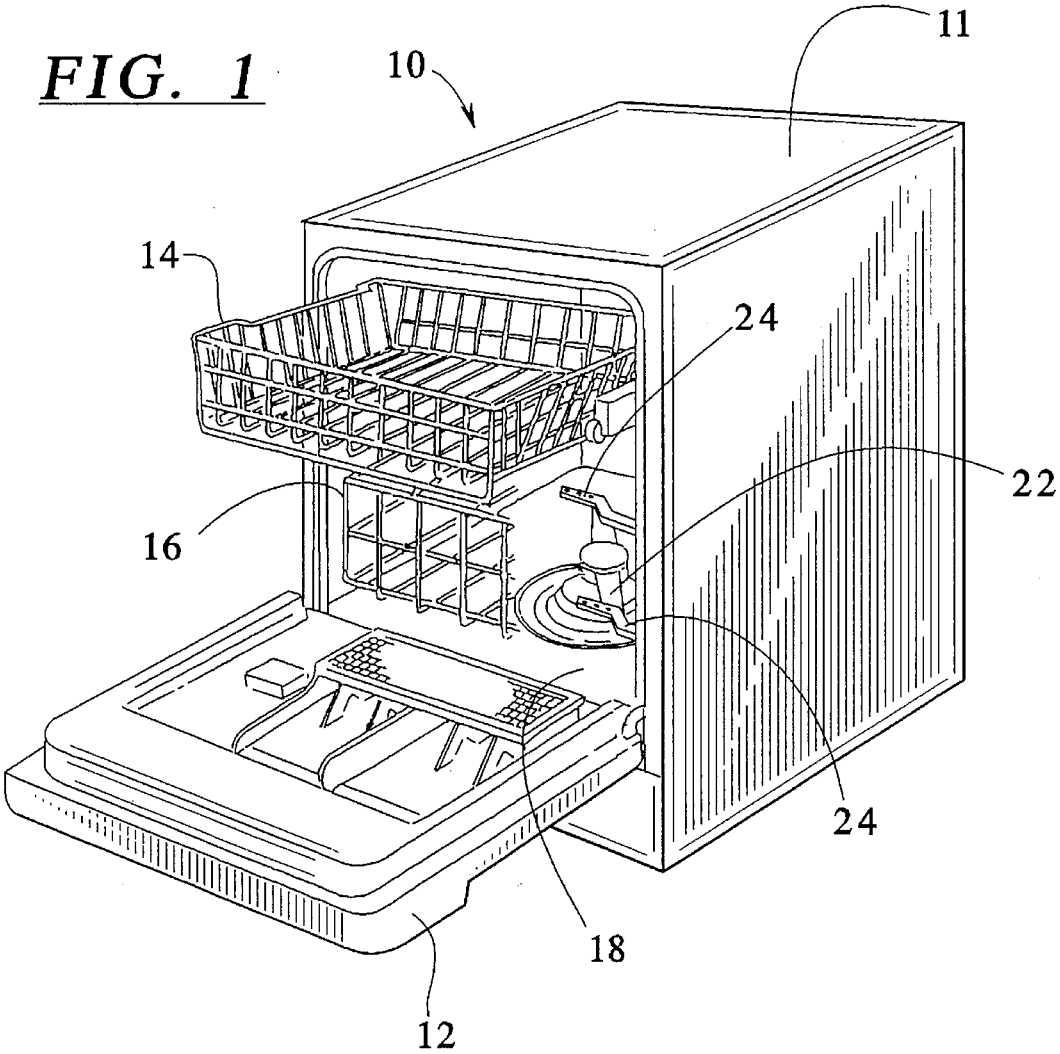
FIG. 1 is a perspective view of a dishwasher according to the present invention, having a portion of a dish rack broken away.
Figure 3:
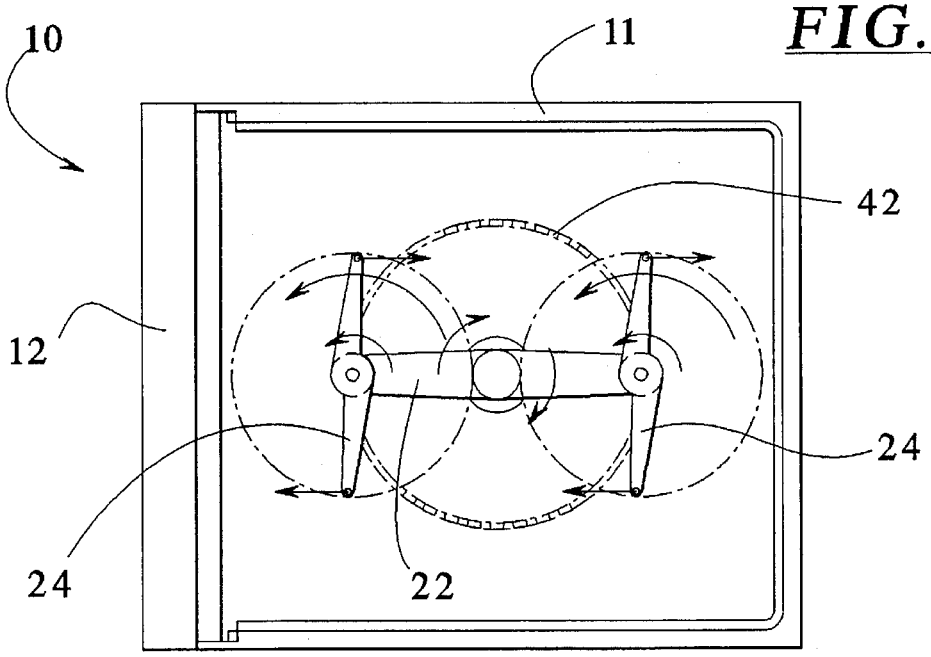
FIG. 3 is a top schematic view of the food soil handling system according to the present invention.

In accordance with the invention described with reference to the accompanying figures wherein like numerals designate like parts, a dishwasher 10 is provided as illustrated in FIG. 1. The dishwasher 10 has a housing 11, a door 12, and an upper 14 and lower wire rack 16 for holding dishes. The housing 11 generally defines a wash cavity 17 with a bottom wall 18 having a circular sump 20 (FIG. 3). In the embodiment illustrated in FIG. 1, a main carrier arm 22 is rotatably disposed above the bottom wall 18. Rotatably mounted at the ends of the carrier arm 22 are two driver arms 24.

Figure 2:
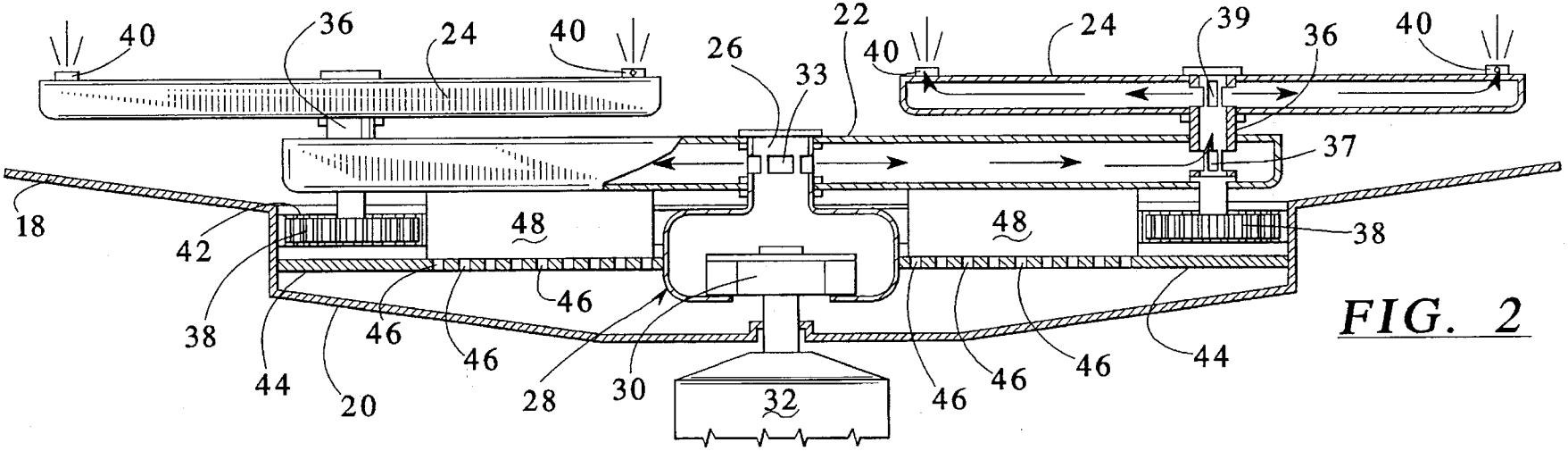
FIG. 2 is a side view of a food soil handling system according to the present invention, partially in elevation and partially in section.

Referring to FIG. 2, the carrier arm 22 is rotatably mounted onto a hub 26, which extends upwardly above the sump 20. The hub 26 is formed integrally with the housing of a pump 28 within which an impeller 30 is located. The impeller 30 is driven by a motor 32.

The carrier arm 22 is hollow and receives water pumped through apertures 33 in the hub 26. Furthermore, the carrier arm 22 is elongated in shape and is mounted to the hub 26 generally midway between ends of the carrier arm 22.

The two driver arms 24 are rotatably mounted at opposite ends of the carrier arm 22. Each driver arm 24 is carried on a top end of a shaft 36 which extends through the carrier arm 22. A lower end of the shaft 36 has a driver gear 38 secured to it. The shaft 36 is free to rotate relative to the carrier arm 22, but the driver arm 24 and the driver gear 38 are mounted to the shaft 36 so that no relative rotation occurs between the driver arm 24 and the driver gear 38.

Each shaft 36 and driver arm 24 is hollow and the shaft 36 is provided with inlet 37 and outlet 39 apertures to permit a flow of water through the shaft into the driver arm. A plurality of nozzles 40 are provided in the driver arms 24. As illustrated by the arrows in FIG. 2, water flows from the sump 20, through the pump 28 and into the carrier arm 22. Water then flows through the shafts 36 into the driver arms 24, from where the water escapes under pressure from the nozzles 40.

The nozzles 40 are configured to direct a water spray in a direction for thrusting the respective driver arms 24 to rotate in a common rotational direction. As illustrated, each driver arm 24 has two nozzles 40, one being positioned at each end of the driver arm. However, more or fewer nozzles 40 can be provided. Preferably, all of the nozzles 40 are directed to thrust the respective driver arms 24 to rotation, as opposed to a conventional system wherein some nozzles 40 can be configured to provide no thrust.

Turning to FIG. 3, a stationary ring gear 42 is mounted to the bottom wall 18 in a fixed manner. In the embodiment shown, the stationary gear 42 is circular and has a diameter approximately equaling the length of the carrier arm 22. The driver gears 38 are arranged as planet gears to engage the stationary gear 42.

As indicated by the arrows in FIG. 3, water thrust from the nozzles 40 results in counter-clockwise rotational motion of each driver arm 24. Because the driver gears 38 are secured to rotate with the driver arms 24, the driver gears 38 engageably roll along the stationary gear 42. As the driver gears 38 rotate, the carrier arm 22 is rotated in a clockwise direction. Thus, each nozzle 40 follows a constantly changing path.

Figure 4:
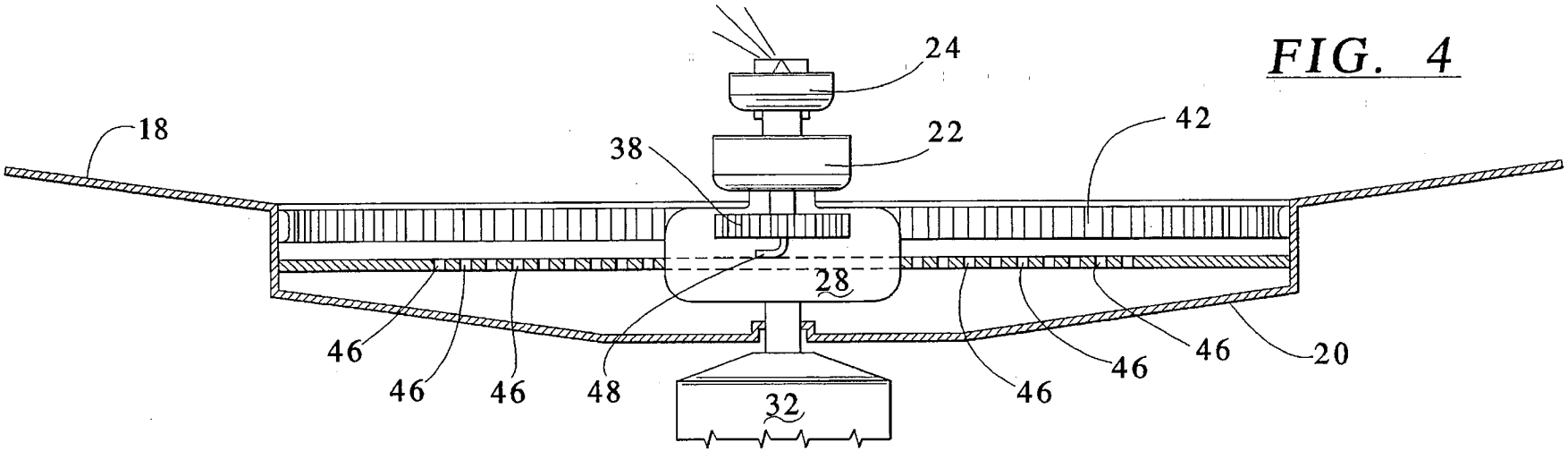
FIG. 4 is a side sectional view of the food soil handling system of FIG. 2, the carrier arm (in elevation) being rotated to a different position.

As illustrated in FIGS. 2 and 4, the stationary gear 42 is disposed around a periphery of the sump 20. Below the ring gear, a flat annular plate 44 is disposed across the top of the sump 20. Perforations 46 are provided in the plate 44 for permitting a flow of wash water therethrough. Wash water drains through the perforations 46 and collects in the sump 20. The pump 28 recirculates the water from the sump 20 back through the spray arms 22, 24.

Secured to the main carrier arm 22 are two flexible wipers 48. Each wiper 48 extends downwardly from the carrier arm 22 between the pump 28 and the driver gears 38 to resiliently contact an area of the plate 44 having the perforations 46. During operation, as wash water falls onto the plate 44, food particles can get stuck in the perforations 46, if they are too large to pass through the perforation. As the wipers 48 wipe around the plate 44, soft food particles are mashed and forced through the perforations 46.

Water washes the mashed, soft food down into the sump 20. Hard food particles which are too large to fit through the perforations 46 are swept along the surface of the plate 44, eventually wearing down in size or ultimately being removed from the plate 44 by a user after a wash cycle is finished.

Preferably, food soil carried by the wash water is removed by a conventional removal system such as that disclosed in U.S. Pat. No. 5,165,433 or some other soil separator arrangement (not shown). If a hard item gets stuck in a perforation, the wipers 48 resiliently flex to pass over the object. Also, hard foreign objects mistakenly placed in the dishwasher 10, such as wedding rings, coins, screws, nuts, etc., are wiped around atop the plate 44 for later retrieval without danger of damage to either the items or the dishwasher 10.

It should be understood that various changes and modifications to the presently preferred embodiments described herein will be apparent to those skilled in the art. Such changes and modifications may be made without departing from the spirit and scope of the present invention and without diminishing its attendant advantages. For example, the carrier arm 22 can be configured to carry a different number of driver arms such as one, three, four, etc. Also, the directions of motion indicated by arrows in FIG. 3 can simply be reversed by reversing the direction of the nozzles 40. Furthermore, another gear arrangement could be provided, for example, wherein the stationary gear has outwardly directed teeth and the driver gears engage around an outer periphery thereof. It is, therefore, intended that such changes and modifications be covered by the appended claims.

The embodiments of the invention in which an exclusive property or privilege is claimed are therefore defined as follows:

1. A food soil handling system for a dishwasher comprising:

a drain plate located at a bottom of the dishwasher, the plate having a plurality of perforations to drain fluid from the dishwasher therethrough;

a rotatable carrier arm disposed above said plate for moveably delivering a spray of water; and at least one wiper element secured to said arm positioned to resiliently contact against said plate, each wiper element operable to force soft separable materials through said perforations with said drained fluid.

2. A food soil handling system according to claim 1 wherein said wiper elements are sufficiently resilient to pass over hard items stuck in said perforations.

3. The food soil handling system according to claim 1 further comprising:

a hub on which said carrier arm is mounted, wherein said plate is annular and disposed around said hub.

4. A food soil handling system for a dishwasher comprising:

a plate having a plurality of perforations to drain fluid therethrough;

a rotatable carrier arm disposed above said plate;

at least one wiper element secured to said arm positioned to resiliently contact against said plate, each wiper element being operable to force soft separable materials through said perforations;

at least one driver arm rotatably mounted to said carrier arm;

a stationary gear; and a driver gear rotatable with each driver arm, said driver gear being engaged with said stationary gear whereby rotation of each driver arm causes said carrier arm to rotate.

5. The food soil handling system according to claim 4 further comprising:

nozzles in each driver arm to expel a flow of water therefrom, the nozzles being directed to thrust said driver arm to rotate.

6. The food soil handling system according to claim 4 having two driver arms.

7. The food soil handling system according to claim 4 wherein the stationary gear is disposed annularly around a periphery of said plate and each driver gear is positioned to engageably rotate around an interior of said stationary gear.

8. The food soil handling system according to claim 4 wherein in each driver arm is rotatably mounted on an end of said carrier arm.

* * * * *